US007565747B2

(12) United States Patent
Cobb et al.

(10) Patent No.: US 7,565,747 B2
(45) Date of Patent: Jul. 28, 2009

(54) DOUBLE-EDGED UTILITY KNIFE

(76) Inventors: Noel C. Cobb, 238 E. Main St., Rockaway, NJ (US) 07866; Edward Bilenski, 10 Manning Ave., Butler, NJ (US) 07405

( * ) Notice: Subject to any disclaimer, the term of this patent is extended or adjusted under 35 U.S.C. 154(b) by 0 days.

(21) Appl. No.: 11/352,728

(22) Filed: Feb. 13, 2006

(65) Prior Publication Data

US 2006/0123637 A1 Jun. 15, 2006

Related U.S. Application Data

(63) Continuation-in-part of application No. 10/822,240, filed on Apr. 9, 2004, now abandoned.

(51) Int. Cl.
*B25G 1/00* (2006.01)

(52) U.S. Cl. ..... 30/329; 30/340; 30/342

(58) Field of Classification Search ..... 30/162, 30/169, 329, 330, 340, 342, 294; D8/98, D8/99

See application file for complete search history.

(56) References Cited

U.S. PATENT DOCUMENTS

| | | | | | |
|---|---|---|---|---|---|
| 619,131 | A | * | 2/1899 | Britt | 30/169 |
| 1,195,297 | A | * | 8/1916 | Vlchek | 30/169 |
| 1,327,155 | A | * | 1/1920 | Gottschalk | 30/162 |
| 1,493,372 | A | * | 5/1924 | Moon | 30/169 |
| 1,704,376 | A | * | 3/1929 | Teasdale | 30/169 |
| 2,010,744 | A | * | 8/1935 | Anderson | 30/169 |
| 2,042,273 | A | * | 5/1936 | Okun | 30/340 |
| 2,215,216 | A | * | 9/1940 | Gits et al. | 30/162 |
| 2,242,900 | A | | 5/1941 | Bender | 30/154 |
| 2,261,063 | A | * | 10/1941 | Joyce | 30/346 |
| 2,304,332 | A | | 12/1942 | Bodkin | 30/335 |
| D163,562 | S | * | 6/1951 | Bjork | 30/353 |
| 2,674,005 | A | * | 4/1954 | Simon | 30/169 |
| 2,679,100 | A | | 5/1954 | Ehler | 30/337 |
| 2,784,489 | A | | 3/1957 | Reise | 30/151 |
| 2,788,574 | A | | 4/1957 | Marcmann | 30/320 |
| D196,709 | S | * | 10/1963 | Johnson | D32/48 |
| 3,107,426 | A | | 10/1963 | Robinson, Jr. | 30/162 |

(Continued)

FOREIGN PATENT DOCUMENTS

WO WO 2007095130 A2 * 8/2007

OTHER PUBLICATIONS

International Preliminary Report on Patentability, International Preliminary Examining Authority, Feb. 19, 2009, 6pgs.

(Continued)

*Primary Examiner*—Jason Daniel Prone
(74) *Attorney, Agent, or Firm*—The Marbury Law Group, PLLC

(57) ABSTRACT

A double-edged utility knife for carpet installers, roofers, glaziers and sheet rock workers has a two-part handle. The handle clamps a detachable reversible double-edged blade at a transverse angulated position with respect thereto. Vertical cuts can be made in tight corners without applying excessive force. The transversely angulated knife blade affords access permitting vertical cuts in tight corners. During cutting the user's hands are displaced from the cutting line, and kept from being inline with the cutting blades. Operation-induced injuries are virtually eliminated. The double edge blade is provided with a geometry especially well suited for wallboard, roofing, carpet cutting/glue scraping and glazier use.

14 Claims, 7 Drawing Sheets

U.S. PATENT DOCUMENTS

| | | | | | |
|---|---|---|---|---|---|
| 3,324,548 | A | | 6/1967 | Mascia | 30/125 |
| 3,380,159 | A | | 4/1968 | Winston | 30/293 |
| 3,604,113 | A | * | 9/1971 | Cuscovitch | 30/331 |
| 3,626,592 | A | * | 12/1971 | La Cas et al. | 30/339 |
| 3,906,625 | A | | 9/1975 | Gringer | 30/125 |
| 3,927,473 | A | * | 12/1975 | Braginetz | D8/98 |
| 3,965,575 | A | * | 6/1976 | Stunger | 30/294 |
| 4,068,375 | A | * | 1/1978 | Rathbun et al. | 30/164 |
| 4,109,380 | A | * | 8/1978 | Anderson | 30/162 |
| D258,488 | S | * | 3/1981 | Juziuk | D8/98 |
| 4,542,554 | A | * | 9/1985 | Wallerstein | 30/169 |
| 4,575,940 | A | | 3/1986 | Wenzel | 30/335 |
| 4,617,736 | A | * | 10/1986 | McCrary | 30/169 |
| 4,713,884 | A | | 12/1987 | Dunnagan | 30/294 |
| 4,884,342 | A | | 12/1989 | McNamara et al. | 30/162 |
| 4,890,351 | A | * | 1/1990 | Wilson | 30/169 |
| 4,967,476 | A | * | 11/1990 | Mozeliak | 30/312 |
| 5,014,429 | A | | 5/1991 | McNamara | 30/162 |
| 5,107,593 | A | * | 4/1992 | Hutchins | 30/169 |
| 5,174,028 | A | * | 12/1992 | Seltzer, Jr. | 30/329 |
| 5,208,984 | A | * | 5/1993 | Negus | 30/169 |
| 5,241,750 | A | | 9/1993 | Chomiak | 30/2 |
| 5,400,512 | A | * | 3/1995 | Brush | 30/340 |
| 5,490,331 | A | | 2/1996 | Gold | 30/143 |
| 5,561,906 | A | * | 10/1996 | Desmarais | 30/339 |
| 5,720,105 | A | * | 2/1998 | Gates | 30/162 |
| 5,890,294 | A | | 4/1999 | Keklak et al. | 30/125 |
| 5,906,049 | A | | 5/1999 | Butts | 30/125 |
| 6,192,589 | B1 | | 2/2001 | Martone et al. | 30/125 |
| 6,253,454 | B1 | * | 7/2001 | Gietzen | 30/169 |
| 6,321,455 | B1 | * | 11/2001 | Burchell | 30/340 |
| 6,324,762 | B1 | * | 12/2001 | Huang | 30/332 |
| 6,453,563 | B1 | * | 9/2002 | Farland | 30/329 |
| 6,745,478 | B2 | * | 6/2004 | DeLillo | 30/299 |
| 6,848,185 | B2 | * | 2/2005 | Tebo | 30/162 |
| 6,895,674 | B2 | * | 5/2005 | Ai | 30/162 |
| 2003/0110641 | A1 | * | 6/2003 | Gringer | 30/169 |
| 2004/0000055 | A1 | * | 1/2004 | Lee Fan | 30/162 |
| 2005/0223567 | A1 | * | 10/2005 | Cobb et al. | 30/339 |

OTHER PUBLICATIONS

International Preliminary Report on Patentability, International Preliminary Examining Authority, Mar. 9, 2009, 5pgs.

* cited by examiner

DOUBLE-EDGED UTILITY KNIFE

This is a continuation-in-part of application Ser. No. 10/822,240, filed Apr. 9, 2004, now abandoned entitled Utility Knife For Glaziers.

BACKGROUND OF THE INVENTION

1. Field of the Invention

This invention relates to utility knives for operations such as glazing, roofing carpeting and sheet rock fabrication wherein the knife is used in close proximity to window edges or close-by walls; and more particularly to a knife that facilitates cutting in a direction perpendicular to the surface appointed to be cut while, at the same time, minimizing injury to the user.

2. Description of the Prior Art

Tools have long been used for line cutting in glazing and sheet rock installation. U.S. Pat. No. 2,242,900 to Bender discloses an adjustable tool holder and cutting device appointed for cutting paper, fabric, leather, felt, packing, cardboard, flowers, and the like. Holders of this type have conventionally been used by glaziers. The holder comprises a handle having a longitudinal guide slot to accommodate a cutting tool. A screw passes through the guide slot and engages a locking nut to secure the cutting tool in various extensions and positions. The tool holder is constrained to lie in the plane of a longitudinal guide slot parallel to the wide side of the handle, and is therefore in-line with the handle. No alignment pin or other structure is used to positively and rigidly mount the blade and prevent extension of the tool to a significant extent.

U.S. Pat. No. 2,304,332 to Bodkin discloses a scraping and cutting device comprising a holder adapted to retain a single-edged razor blade. The blade has a recess or aperture therein and a reinforcing member tightly clamped around one of the razor blade's edges. The holder comprises a pair of handle members, each of which is pivotally secured adjacent one end. A spacing member holds the handle members apart sufficiently to permit insertion and movement of the razor blade between the handle members. The opposite ends of the handle members have their ends formed obliquely to the axes of the members. A longitudinally extending channel in each of the handle members is provided for receiving the reinforcing member of the razor blade so as to either hold it within the handle or to project it in a cutting position beyond the oblique ends of the handle. A bolt and screw clamping means passes through slots in the handle members and through a recess of the blade. The clamping means may be loosened to permit movement of the blade within the holder or tightened to securely engage the blade in cutting or scraping position. Each handle member is further provided with a transverse channel extending across the width of, and substantially parallel to the oblique end of, the handle member. The reinforcing member of the razor blade may be placed in the transverse channel and the clamping means tightened to hold the blade in the scraping position. With this arrangement, the blade is in line with the handle and the blade extension is small and is controlled by position of the blade in the channel. In addition, there is lacking any alignment pin or similar means for positively locating the extension of the blade. Consequently, the device must rely solely on friction that results from the tightening of a bolt and screw tightening means.

U.S. Pat. No. 2,679,100 to Ehler discloses a knife for cutting linoleum and the like. The knife comprises a handle holding a removable blade. The handle comprises two halves, each having a blade-receiving end with a channel of the width of the blades the handle is to receive. The halves are assembled by using a screw. Pins are provided in one half for insertion in corresponding sockets in the opposite half to assure proper association of the halves upon assembly. A blade-locating lug extending from the wall of the channel engages a slot in the blade. In one embodiment the blade projects generally along the long axis of the mating halves of the handle. In another embodiment, the blade extends from the bottom edge of the handle at an angle obtuse a predetermined degree suitable for linoleum cutting in the handle plane. Significantly, there is no disclosure concerning a knife having transverse angulation of its cutting blade, maintaining the angularity of the knife blade with respect to the handle. Instead, the blade is constrained to be located in a recess in one of the sides of its handle. With this configuration, the blade of the knife is substantially co-planar with the inside surfaces of the sides of the assembled handle and has no ability to produce perpendicular cuts to a surface in close location, such as that required in glazing and sheet rock operations.

U.S. Pat. No. 2,784,489 to Reise discloses a hand holder for utility blades used by craftsmen and others for cutting roofing materials, linoleum, and the like. The blade holder is said to have a forwardly movable guard for protecting the blade when not in use and provision for ready adjustment of the blade projection, convenient replacement of the blade, and storage space for extra blades. The holder has an open, forward end containing a rectangular cavity adapted to receive the guard in sliding association. The guard has a blunt nose-shaped forward end, side grooves, a rectangular recess adapted to receive the blade and a flat cover piece, and an elongated opening through the upper portion of the guard. A finger knob protrusion is provided in the rear bottom portion of the guard to allow a user to slide the guard backward and forward. Sliding the guard backward into the cavity of the holder exposes the blade, while sliding the guard forward shields the blade. A bolt penetrates one side of the holder. The bolt passes through the blade guard, an alignment notch atop the blade, and the cover piece; and thence through the opposite side of the holder, where it is engaged by a nut. Tightening the nut secures the blade and guard in position. The blade is in-line with the handle and not transversely angled and rigidly mounted.

U.S. Pat. No. 2,788,574 to Marcmann discloses a utility knife having a handle and blade which may be fixed in a number of different positions therein to suit different cutting purposes. The blade may be set to project in a straight line from one end of the handle to provide blades of different lengths and with different amounts of cutting edge and different degrees of rigidity or stiffness. The blade may also be set at an angle to the length of the handle for cutting linoleum and similar materials. The blade is not symmetrical with respect to its first opening. It has one end located at a greater distance from the first opening, and is inclined to the longitudinal axis of the blade at a greater angle than the opposite end. The blade may thus be mounted in the holder in a plurality of alignments which provide different lengths of exposed cutting edge and different degrees of blade rigidity. The blade may further be provided with a second opening so that the locating pin may be passed through the second opening while one end edge of the blade abuts one side of the recess in the second part. When so mounted the blade projects downwardly at an angle from the holder. The blade is in-line with the handle and not transversely angled and rigidly mounted.

U.S. Pat. No. 3,107,426 to Robinson, Jr. discloses a utility knife having a knife blade adapted for slidable movement between a safety position within the knife handle and an extended cutting position. The knife comprises an elongated handle having a blade-receiving slot at one of the ends thereof. The handle comprises two elongated members detachably secured and separable along a longitudinal plane extending rearwardly from the slot opening. A carrier is reciprocally mounted on one of the elongated members for movement toward and away from the slot opening. A blade is supported on the carrier and has parallel edges that engage side flanges extending from the base of the carrier. An elongated tongue extends rearwardly from the carrier and engages a locking cam surface on the handle. A button is fixed to the tongue and may be depressed to move the tongue out of engagement with the locking cam surface, and to slidably reciprocate the tongue within the handle. The knife may further comprise a compartment for storage of spare blades. The members of the handle are secured by a screw. Significantly, the knife blade retraction mechanism requires that the blade and the inside surfaces of the handle halves be substantially coplanar. The knife, therefore, lacks transverse blade angulation.

U.S. Pat. No. 3,324,548 to Mascia discloses a tool-holding knife comprising a handle, a bifurcated tool holder, and blade. The knife is said to be especially useful for cutting linoleum, vinyl, carpeting, and the like. The tool holder is provided with two branches, spaced apart by rivets which also serve to buttress various of the blades which are usable with the tool holder and appointed to be situated between the branches. Several positions are described for mounting the blades in the holder, including a straight knife position, a generally perpendicular scraping position, and a downwardly angled position for cutting linoleum or the like. A blade must be inserted between two closely spaced branches of the device and is held by friction. Here again the blade is in-line with the handle and lacks rigid mounting needed for an angled blade.

U.S. Pat. No. 3,380,159 to Winston discloses a cutting device for opening shipping containers and the like of cardboard or similar material. The cutting device is designed to prohibit the damage of merchandise contained therein. The device is preferably formed of two flat sheets of heavy gage sheet metal pivotally affixed to one another at one end by a pivot pin. The sheets are formed to provide oppositely disposed cavities between them for storage of spare cutting blades. The ends of the sheets opposite the pivoted end are formed to provide a cutting blade retainer. The edges of the sheets form a straight edge on the retainer, which is angularly disposed with respect to the handle to provide a clearance for the knuckles and fingers of a user of the cutting device. The cutting blade retainer has a recessed blade cavity of substantially the same depth and width as the thickness and width, respectively, of a cutting blade seated in the retainer. A shoulder bolt is inserted through aligned apertures in the blade and the sheets, and engages a nut to fasten the blade and sheets together. The end of one of the sheets further comprises an extended end formed to provide a runner support and a runner extending below and substantially perpendicular to the runner support and in a parallel spaced relationship to the straight edge, thereby forming a slot. The runner preferably has a semi-round cross-section to give it sufficient strength to pierce cardboard without buckling or flexing. The runner also has an outwardly curved surface facing away from the slot to provide protection for the merchandise contained within the shipping container by allowing only a minimal amount of the runner to be in touch with the merchandise Significantly, the runner structure of the knife limits the extent of blade penetration and thus severely limits the utility of the knife for glazing and similar operations wherein a blade is expected to penetrate to a substantial depth perpendicular to the cutting surface. Moreover, the lack of transverse angulation of the in-line cutting blade further restricts suitability of the device for outside cutting operations.

U.S. Pat. No. 3,906,625 discloses a utility knife comprising a handle and a blade removable therefrom. The handle comprises a sleeve-like handle member having a cavity portion therein and a blade carrier member. The cavity portion comprises a longitudinal slot with the handle being open at its base and at one end of the slot. The carrier is pivotally mounted to the handle at the other end thereof opposite from the open slotted end for pivotal movement into and out of the cavity. The carrier has a longitudinal extent substantially equivalent to that of the longitudinal handle and has a plurality of studs at its end adapted to support a perforated cutting blade in a plurality of orientations relative to the handle. The blade carrier also comprises an integral, resilient clip portion for fixedly holding replacement blades for storage and resilient protrusions, which assist in holding the blade carrier within the handle in the closed position. The blade is in-line with the handle and lacks rigid mounting needed for an angled blade.

U.S. Pat. No. 4,575,940 to Wenzel discloses a carpet layer's knife having a handle and blade holder for demountably securing a heavy-duty, razor-style blade having two generally parallel sharpened edges and an open center section with a slot elongated in a direction parallel the sharpened edges, for mounting the blade in the handle. The holder comprises two body sections, which part along a medial longitudinally extending plane. The body sections have blade-holding portions at one end. A screw connecting means, which tightens to clamp the blade between the blade holding portions, connects the body sections. A shoulder formed in the blade-holding portion of one of the body sections passes through the center slot in the blade and provides support against rotation of the blade in its plane during use of the knife. Resilient means comprising a spring, surrounds the screw connecting means to urge the body sections apart when the screw connecting means is loosened, thereby facilitating insertion and removal of blades. The screw connecting means is provided with a manually engageable extension such as a D-ring for applying torque to the screw without necessity of an additional tool, such as a screwdriver, when changing blades. A blade compartment may be provided for storage of spare blades. Significantly, the knife is angulated longitudinally: the blade is in-line with the handle and lacks rigid mounting needed for an angled blade.

U.S. Pat. No. 4,713,884 to Dunnagan discloses a hand-held knife for use in cutting carpet pads. The knife comprises a handle having a pair of handle members generally abutting at a median plane, a blade is positioned therebetween, and a releasable fastener clamps the handle members together and secures the blade. The use of the knife depicted is said to reduce the propensity of carpet pad to wrinkle while being cut, thereby improving the accuracy of the cut and decreasing the fatigue experienced by the carpet pad installer. The knife comprises a handle portion, a forwardly projecting blade support portion formed at generally an angle of 30 to 45 degrees with respect to the long dimension of the handle, and a heel at the transition between the portions. A raised boss present on the inside surface of one of the blade support portions of the right side member of the handle is sized to be received in a longitudinal slot present in a knife blade of conventional design. The orientation of the boss establishes the angle of the blade cutting edge with respect to the handle. A thumbwheel having a threaded extension penetrates an aperture in one half of the handle generally at its heel and engages a corresponding internally threaded aperture in the opposite handle half to clamp the halves together and secure the blade in position. The handle members may optionally comprise a storage compartment for spare knife blades. The blade is in-line with the handle and lacks rigid mounting needed for an angled blade.

U.S. Pat. No. 4,884,342 to McNamara et al. discloses a cutting device including a handle and a blade particularly adapted for cutting wallpaper. The handle is elongated and comprises two half-handles secured together. At least one of the half-handles has a lengthwise internal passageway in its sidewall and at least one of the half-handles has a lengthwise external opening in its sidewall, the opening and the passageway being at least partially coextensive. An elongated blade is slidably and retractably mounted between the sidewalls and is extendable from the front end of the handle. A protruding member is slidably mounted within the internal passageway and is removably fixed to the blade. A biasing means is positioned against the blade to hold the blade against the protruding member. A releasing means is provided for moving the blade laterally against the biasing means so as to allow the blade to be released from the protruding member, thereby facilitating replacement of the blade. An adjustment means slidably mounted in the opening allows the extension of the blade from the handle to be varied. A roller means is situated at the front end of the handle to guide the blade along a cutting path. A guidance mechanism is rotatably connected to the handle. The blade is in-line with the handle and lacks rigid mounting needed for an angled blade.

U.S. Pat. No. 5,014,429 to McNamara discloses a utility knife including a mechanism for detaching individual segments from a segmented knife blade. The knife includes a housing having two mating, spaced side wall portions with a channel therein to house and guide a blade. One end of the channel terminates within the housing, while the other end opens to form an exit slot from which the blade may protrude. An adjustment mechanism is disposed for back and forth sliding movement within a slot in the sidewall. A boss is provided on the adjustment mechanism to engage an aperture in the blade. One of the sidewalls also has a recess to accommodate a spring member which provides a force both to bias the blade against the opposite side wall portion, thereby presenting rattling or lateral displacement of the blade, and to bias the blade against the adjustment member to maintain engagement of the boss with the blade. The sidewall further accommodates a mechanism to allow individual segments to be severed from the blade and capture the severed piece in a safe manner for disposal. The mechanism comprises a transversely oriented plunger which, when depressed against the blade, causes fracture of the blade along a pre-formed segmentation line. Opposite the plunger in one of the sidewalls is a recess appointed to receive the severed blade segment, thereby restraining it from flying away from the knife uncontrollably. An aperture is provided in the recess, from which the severed segment may be removed at the user's convenience. The blade is in-line with the handle and lacks rigid mounting needed for an angled blade U.S. Pat. No. 5,241,750 to Chomiak discloses a utility razor safety knife having a handle and a blade and a blade guard attached thereto. The blade guard comprises an open-bottomed hood pivotally secured to the handle by a screw and biased to the closed position by springs whose bottom ends terminate on footing rests on the sides of the yoke and whose top ends engage a yoke attached to the top of the handle. The screw also acts to secure the blade between complementary halves of the handle. In the closed position, the blade guard both protects the user from the blade cutting edge and protects the blade from being inadvertently nicked or dulled. The knife is used by grasping the handle and pressing the open side of the hood into the article to be cut, thereby causing retraction of the biasing springs and exposure of the blade edge. The footing rests serve to maintain the blade generally perpendicular to the surface being cut and to limit the depth of penetration of the blade. After completion of the cut and withdrawal of pressure on the handle, the springs again urge the blade guard into the closed position. The knife lacks transverse angulation of its blade. In addition, the blade is in-line with the handle and lacks rigid mounting needed for an angled blade.

U.S. Pat. No. 5,490,331 to Gold provides a utility knife adapted both for cutting and scraping. The knife is provided with a retractable blade having a sharpened bottom edge for cutting and a sharpened front edge for scraping. A holder comprises two half-hand grips secured by a screw having a threaded shank and a large diameter cylindrical knurled head. Preferably the head extends laterally of the knife approximately 0.5 inch when tightened to provide additional grip when the knife is drawn rearwardly during cutting use of the knife. The holder is further provided with a downwardly projecting, finger-contacting member which serves as a stop for the user's hand when the knife is being forwardly pushed, as during a scraping stroke of the knife. The blade is in-line with the handle and lacks rigid mounting needed for an angled blade.

U.S. Pat. No. 5,890,294 to Keklak et al. discloses a locking safety utility knife that includes a body and an operating lever, which is squeezed to deploy a retractable cutting blade from within the body. The blade can be locked in its retracted position by means of a ratchet-like mechanism including a pawl adapted to be released by manipulating a cam operator. The pawl engages teeth formed on the outside of a door, which closes the rear of a compartment formed in the operating handle to house spare blades. The blade is in-line with the handle and lacks rigid mounting needed for an angled blade.

U.S. Pat. No. 5,906,049 to Butts discloses a double-ended utility knife with a blade at each of its ends. The two blades are independently reciprocally extendible from respective compartments within the body of the knife and may be of different shapes. The knife comprises a generally rectangular base member having a front side and a backside and front and back covers adapted to be attached to the front and backsides. Each of the covers extends less than the total length of the base member. The provision of separate covers partially covering the respective front and back sides of the base member allows either of the blades to be changed independently without exposing the other and possibly allowing it to be inadvertently dislodged. Each of the blades extendible from the knife is coplanar with the base member of the knife. The blade is in-line with the handle and lacks rigid mounting needed for an angled blade.

U.S. Pat. No. 5,940,970 to D'Ambro, Sr., et al. discloses a utility knife including a holder having two mating halves, a first cavity at a proximal end of the holder for receiving a blade for active use and a second cavity located toward a distal end of the holder for receiving and storing a supply of replacement blades. The mating halves are joined by a hinge at the distal end of the holder and a captive screw closure extending between the mating halves at a position intermediate the first and second cavities. The first cavity incorporates a magnet for engaging the active blade, while the second cavity incorporates a magnet for additionally engaging one or more replacement blades. The knife blade in the patented utility knife is situated generally coplanarly with the mating interior surfaces of the halves of the blade holder. Hence, the blade extends straight from the holder without angulation. The blade is in-line with the handle and lacks rigid mounting needed for an angled blade.

U.S. Pat. No. 6,192,589 to Martone et al. discloses a utility knife including a main body, a blade holder assembly movably mounted within the body, and a manually engageable member slidably mounted on the main body. The blade holder is movable between a retracted position wherein the blade is disposed within the body and an extended position wherein the blade protrudes outwardly from the main body to enable a cutting operation. The manually engageable member is operatively connected with the blade holder assembly and is movable to extend and retract the blade holder assembly. The utility knife further comprises a blade storage member pivotally connected with the main body. The blade storage member is appointed to carry a supply of spare blades. The utility knife also includes a locking structure constructed and arranged to releasably lock the blade storage member in its closed position. Significantly, the knife blade retraction mechanism requires that the blade and the inside surfaces of the handle halves be substantially coplanar. The blade is in-line with the handle and lacks rigid mounting needed for an angled blade.

Utility knifes of various kinds, which have been described and used by prior art workers, all place the knife in-line with the handle and minimize protrusion of the knife to reduce blade breakage. Any angulation suggested is within the plane formed by the handle and the plane of the knife. This arrangement of the knife components fails to solve a troublesome problem encountered by glaziers and sheet rock workers, namely the need to make perpendicular cuts in tight corners. Such cuts require long blade lengths and close placement of a worker's hand in tight corners increasing the risk of injury. An in-line placement of blade and handle prevents a close approach of the knife to the wall edge, due to the size of the worker's hand and in-line location of the blade; it clearly increases the risk of injury.

Key factors that would be desirable when constructing a utility knife for glaziers include transverse angulation to prevent the worker's hand from being in the path of the blade. The transverse angulation would also permit closer knife approaches to corners. It would enable maintenance of a vertical cut and provide adequate blade support to minimize breakage of the angled blade, which encounters substantial pressure during use. However, structures which provide the functionality requisite for achieving these key factors have not previously been proposed by prior art workers.

As a consequence remains a need in the art for a utility knife for glaziers and sheet rock workers, which provides transverse angulation and adequate blade support. Also there is need for knifes usable by left-handed and right-handed users. This need has heretofore not been met by conventional utility knives.

SUMMARY OF THE INVENTION

The present invention provides a double-edged utility knife having a transverse angulation feature that enables carpet cutting and glue scraping, roof work, glazing and sheet rock operations to proceed in a safe, efficient and reliable manner. Generally stated, the double-edged utility knife has a two-piece handle comprising a first section and a second section. A reversible double-edged detachable blade with an anchoring hole is mounted on a locating pin, and attached firmly to the first section or second section. The locating pin locates the blade from forward or reverse motion. The blade is held firmly between the first and second sections, within a channel by clamping the sections together and fixing them in the clamped condition using a fastening means such as a pair of screws, a countersink and threaded tap-hole, which locate the blade firmly in the horizontal plane. A channel in the second member firmly captures the top and bottom edge of the double-edged knife blade against the top and bottom edges of the milled channel and locates the blade in the vertical plane. This rigid attachment means grips the blade firmly by the bolts within the channel located by the locating pin and allows longer protrusion of the blade, without excessive blade bending meeting the needs of glaziers, roofing contractors, carpet installers and sheet rock workers. The second section has a hollow portion providing a milled compartment in the second member for holding one or more blades.

Each of the double-edged blades has symmetrical geometrical structure with four cutting edges and two or more sharp corners. The double-edged blade is therefore reversible end-to-end and side-to-side to provide a fresh cutting edge. The double-sided blade may be replaced with a new blade from the storage compartment within the second member of the handle. If the utility knife is exclusively used for left-handed or right-handed use, the blade may be turned upside down to provide a fresh unused sharp edge. The blade has two holes, which match with the locating pin. The double edge blade is suited for use as a utility knife for left-handed or right-handed cutting without any blade adjustment.

As a consequence of the transverse angulation of its handle, the utility knife is especially convenient for use in window glazing applications, roof cutting or carpet cutting, since the hand is not located in-line with the blade. The transverse angulation may be in the range of 10 degrees to 80 degrees and more preferably between 30 to 45 degrees. The knife no longer needs to be angled in making cuts in tight corners and cuts, which is essentially perpendicular to the surface can be easily made since the size of the hand is accommodated by the transverse, fixed angulation of the handle. The utility knife can be used in right angle applications such as scoring of linoleum or sheet rock in tight places, such as corners and the like. Previous utility knives have been stubby and straight. These prior art configurations prevented facile operation of the knife, owing, in part, to interference from the operator's hands.

The double-edged utility knife of this invention is designed to address a common system for window glazing that comprises use of a frame having a right-angled open channel to accommodate a glass pane. The glazing is accomplished by placing a bed of putty or similar glazing compound along the inside vertex of the channel and then inserting a pane of glass into the bedding compound. The pane is pressed to extrude any excess putty and assure complete coverage of the edge and a fully hermetic seal. The pane may then be secured with glazing points or similar fasteners.

This system is intended to allow replacement of broken glass in a simple manner. However, extraction of the old pane frequently requires use of a sharp knife or similar flat cutting instrument to break the putty seal between the flat surface of the glass near its edges and the sides of the right-angled frame generally parallel thereto, requiring a perpendicular cut. Conventional straight utility knifes, putty knives, or razor blades are often used for this task but have proven to be poorly suited and, in some cases, even hazardous to the artisan. With each of these tools, the user's hand gripping the handle prevents the blade from being aligned with the perpendicular plane of the gap between the window and the frame. The user may attempt by downward pressure against the glass to bend the blade to align and insert it in the gap for cutting. However, the bending and pressure entail significant risk of injury, as the generally brittle blade may snap and project sharp fragments or the glass may fracture and expose the user's hand to laceration. In marked contrast, the transverse angulation of the present knife and stable knife support system obviates these difficulties. Inadvertent breakage of blades is reduced or eliminated. The present utility knife allows making cuts, which are essentially perpendicular to the surface easily, a feature unavailable in knifes where the handle is in-line with the knife blade. The force applied by the user against the glass is significantly lower than that heretofore required to bend the blade of prior art glazing knives. This, in turn, greatly reduces the risk of injury to the artisan from broken glass or blades. The present knife is also far less likely to nick or otherwise damage the window frame.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

As used herein, the term "double-edged utility knife" means that the utility knife is capable of making perpendicular cuts to surfaces which are in close proximity preventing conventional in-line knifes to be used due to their stubby construction as well as inability of hand which grips the handle to approach the region to be cut with the blade in a vertical position. The double-edged utility knife also has the ability to expose a fresh unused edge by reversing the blade side-to-side or left-to-right or use a new knife blade from the holding compartment. Since the double-edged knife blade is omni dexterous it may be used conveniently for left-handed or right-handed use. The double-edged blades have two holes which mate with a locating pin when the blade is rotated by 180 degrees. In both cases, the double-edged utility knife has a first and a second member which holds the knife using a locating pin attached to the second member and the two members are securely held together using two set of bolts. The knife blade sits in a channel milled in the second member so that it does not move. The knife is entirely locked in position within the handle and its position is not maintained by friction. The term 'transversely angulated' means that the knife blade is nominally perpendicular to the plane defined by the blade and the handle and the transversely angulated angle is the angle between the long direction of the handle and the long direction of the blade.

Key features of the design and application of the double-edged utility knife include 1) means for providing support for the knife in all three directions and providing a stable knife blade capable of cutting in the transverse angulated location which applies momentum to the blade; 2) means of clamping the blade in the transverse angulated position using a first member, second member, locating pin and clamping screws; 3) means of using the double-edged blade in a left-handed or right-handed configuration; 4) means of reversing a blade to expose fresh unused edges of a double-edged utility knife; and 5) providing four sharp edges per blade which may be exposed by either reversing or turning a blade upside down so as to maintain left-handed or right-handed use.

Figure 1A:
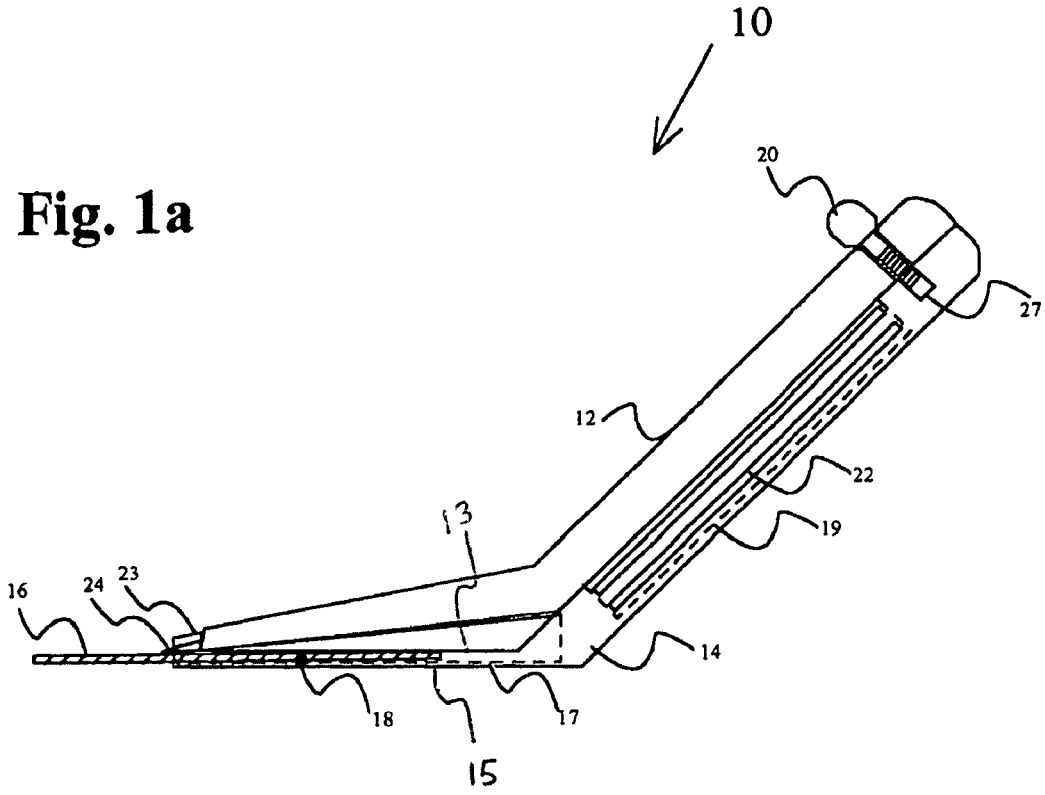
FIG. 1*a* is a perspective view of a double-edged utility knife at 10, which accepts a variety of double-edged blades suited for various applications including carpet installers, roofers and glaziers in the as supplied condition, showing the front view and top view of the transversely angulated knife.
Figure 1B:
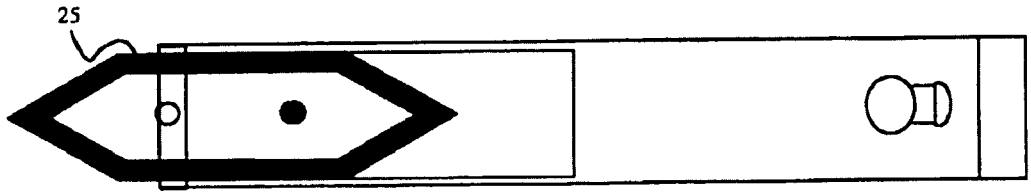
FIG. 1*b* is top view of double-edged utility knife of FIG. 1*a;*

Referring to FIG. 1*a* there is shown the front view and directly below it in FIG. 1*b* a top view of a right-handed utility knife for wallboard use in 10. It shows an extended knife blade element at 16, where it protrudes more than 50% of its length and is held by the left side member 12 and the right side member 14. The left hand member 12 is shown as a transparent body in FIG. 1*b* to illustrate the details of placement of the double-edged wallboard blade 16. The knife blade element 16 is held tightly between the left and right side members 12 and 14 by the clamping means of a bolt 20 that passes through left side member and is threaded into a hole at 27 in the right side member 14. The clamping method may be other than use of a bolt as indicated in the drawing. The holes in the knife blade element 16 mate with a pin or ball protrusion 18 in the right side member 14, and the knife blade element rests in a substantially wedge-shaped channel 17 in the right side member 14. Alternatively, the pin may be attached to the left side member or may be located in holes drilled in the left and right side members. The tip 24 at the end of blade clamping surface 13 on the left side member 12 slides inside a shoe like protrusion in the right side member at 23 so as to hold blade 16 in a lower, off-center position adjacent planar bottom surface 15. The knife blade is easily removed by loosening the bolts 20, and separating the left side member and the right side member. The right side member 14 has a milled cavity at 19 to hold extra knife blade elements 22. Since the double edges blade element 16 is symmetrical it may be used in a left-handed or right-handed configuration without any modification to the double-edged blade.

Figure 2A:
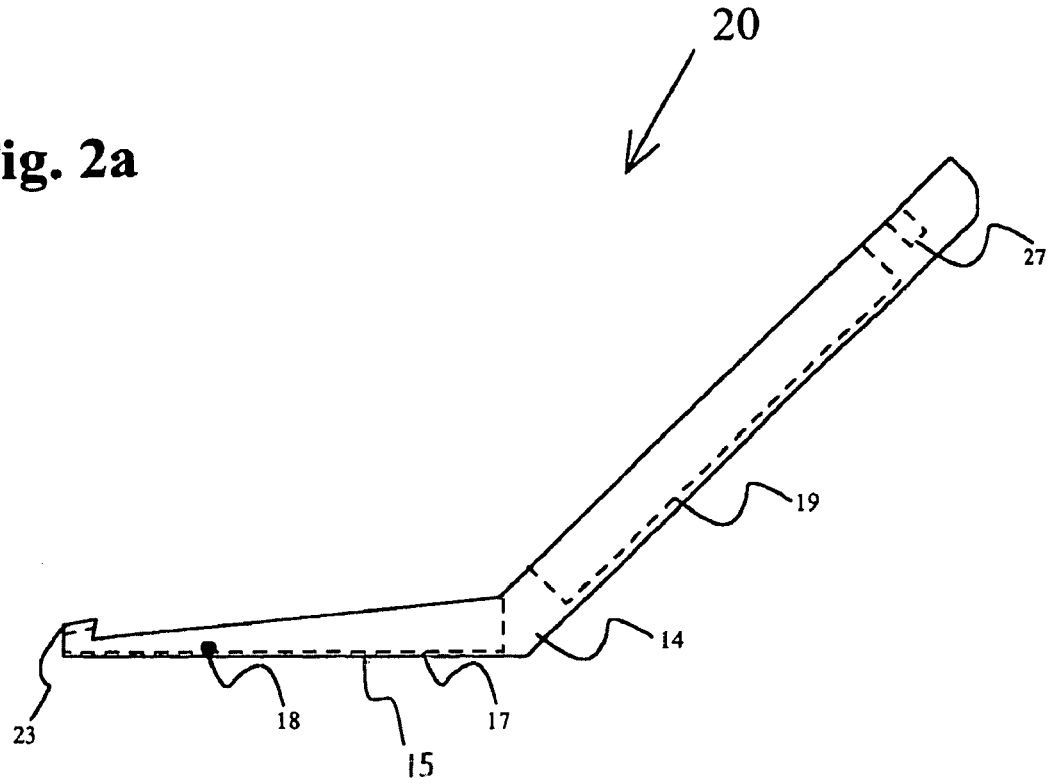
FIG. 2*a* is a front view of the details of right side member 14.
Figure 2B:
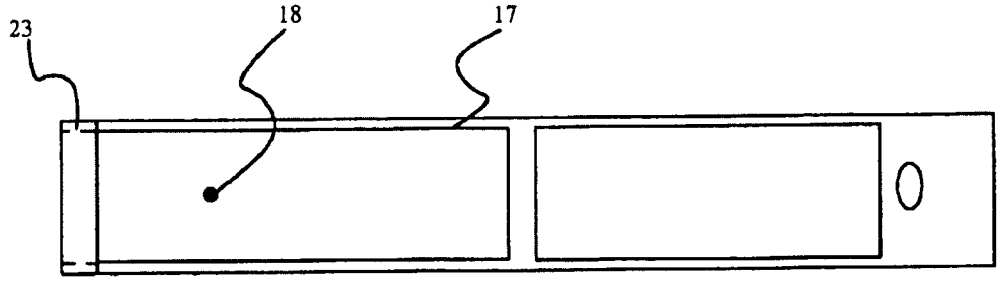
FIG. 2*b* is a top view of the details of right side member 14 of FIG. 2*a;*

Structural details concerning the double-edged utility knife are shown in FIGS. 2*a*, 2*b*, 3*a* and 3*b*. In FIG. 2*a* there is shown a front view detailing right side member 14. Directly below, in FIG. 2*b*, a top view of the right side member is depicted. A substantially wedge-shaped channel 17 is milled adjacent planar bottom surface 15 in the inclined portion to accept the knife blade. The width of the milled channel is exactly same as the width of the double-edged knife blade and is designed to fit as a loose fit. The depth of the milled channel 17 combines with clamping surface 13 to form a space that is slightly less than that of the double-edged knife blade thickness so that when the left and right side members are clamped, the knife blade is firmly held. It also shows the milled opening which houses at least three spare knife blades at 19. The right side member carries the locating pin or ball protrusion 18 within the milled channel 17, as shown to receive the hole in a knife blade element. It has a threaded hole at 27 to accept the bolt 20, which accomplishes the clamping action of the left and right side members. Right side member 14 has a shoe-like protrusion at 23 to accept the tip 24 of the left side member. The threaded portion of the bolt is only as deep as that of the right side member and the bolt fits as a sliding fit into the left side member. Thus, the shoe firmly holds the knife blade element in between the left and right side member even when force is applied to the knife blade.

Figure 3A:
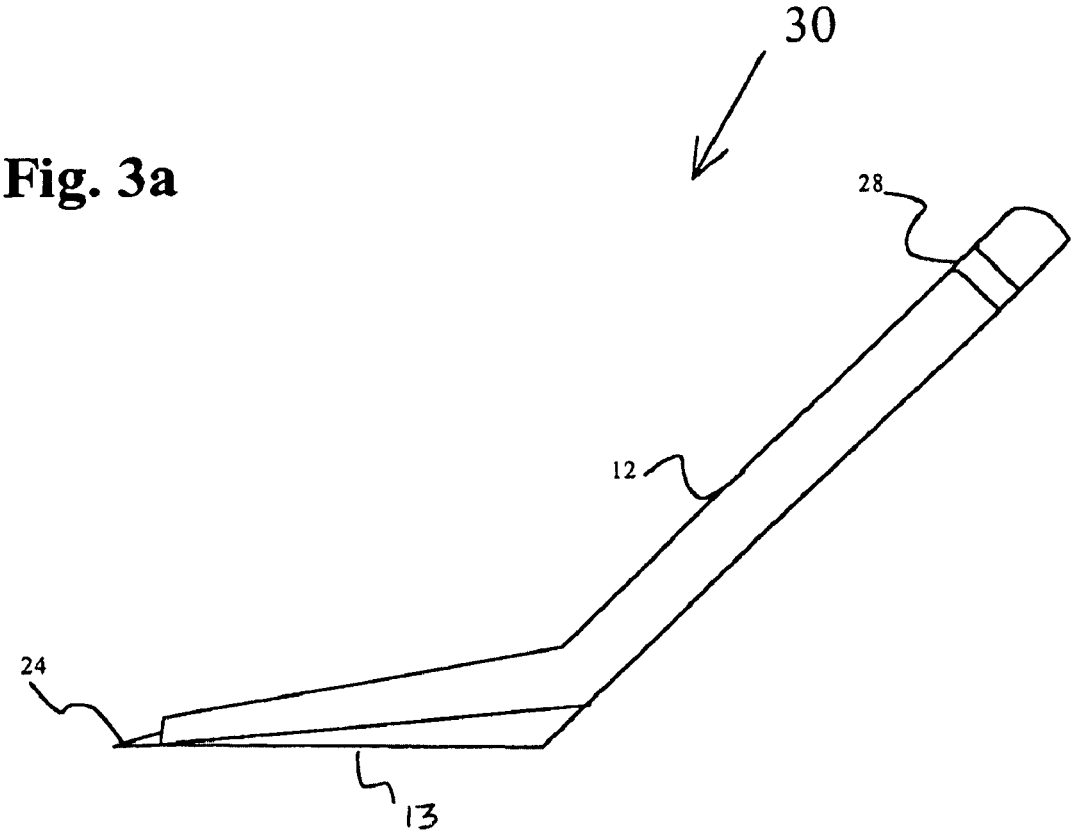
FIG. 3*a* is a front view and top view of the details of left side member 12.
Figure 3B:
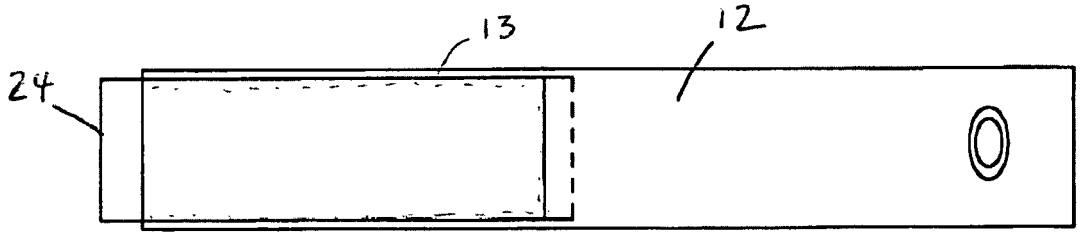
FIG. 3*b* is a top view of the details of left side member 12 of FIG. 3*a;*

FIG. 3*a* illustrates the details of the front view of left side member, 12 and its top view is shown in FIG. 3*b*. The tip 24 of clamping surface 13 on left side member 12 is designed to slide into shoe 23 of the right side member slides and capture the knife blade element 16. The hole at 28 is a clearance hole for the bolt 20.

Figure 4:
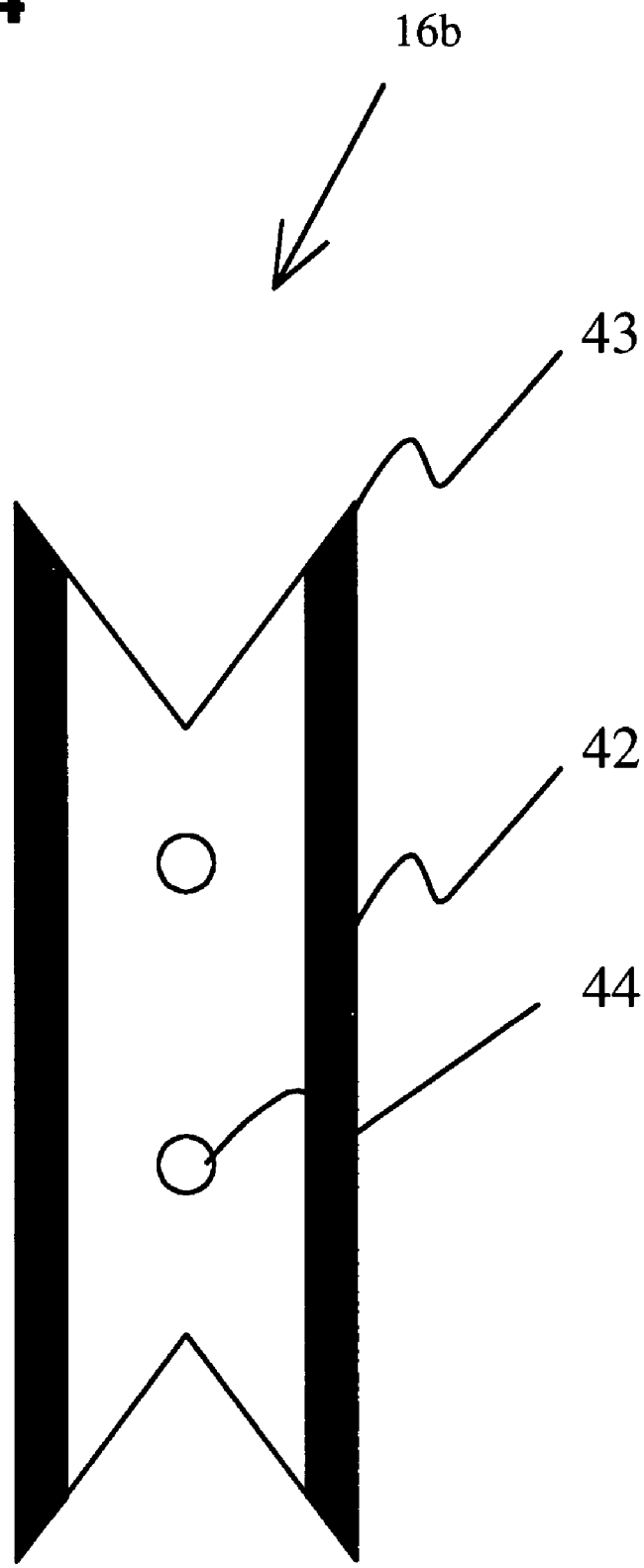
FIG. 4 is a perspective view of the details of a corner utility blade knife element 16 in a configuration as a wallboard blade.

Referring to FIG 4, the detail of the double-edged knife blade element 16 of FIG. 1 configured as a wallboard blade is shown at 16*b*. The double-edged wallboard blade has two sharp edges at 42 and two locating holes at 44. The double edge wallboard blade has four sharp corners suited for scoring wallboards at 43. This double-edged wallboard blade may be used in the forward direction or reversed direction for left-handed or right-handed operation.

Figure 5:
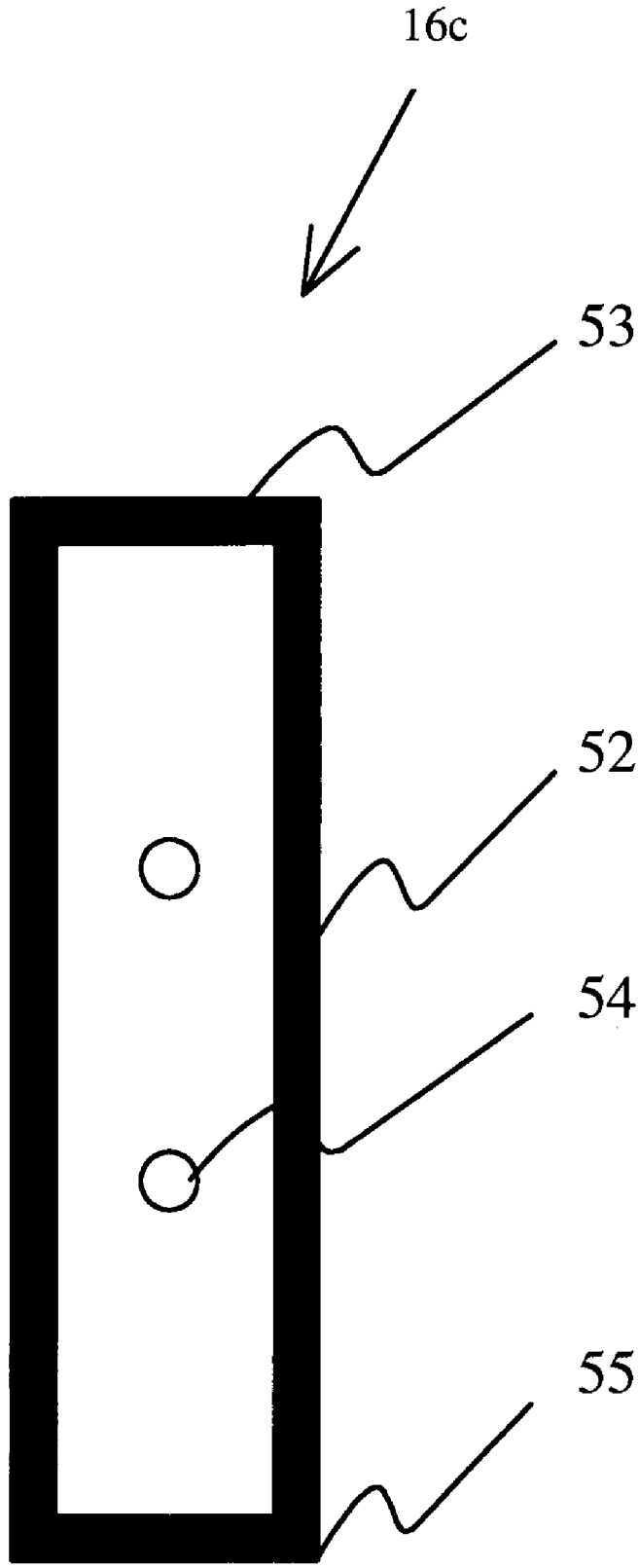
FIG. 5 is a perspective view of the details of a corner utility blade knife element 16 in a configuration as a combination carpet/scraper blade.

Referring to FIG 5, there is shown further structural details concerning the double-edged knife blade element 16 of FIG. 1. As illustrated by FIG. 5, the double-edged knife blade is configured as a combination carpet/scraper blade, shown generally at 16*c*. The double-edged carpet/scraper blade has a sharp edges at 52 and two locating holes at 54. The double edge carpet/scraper blade has four sharp corners suited for scoring carpets at 55. The sharp edge at 53 is used for scraping carpet glue. This double-edged carpet/ scraper blade may be used in the forward direction or reversed direction for left-handed or right-handed use.

Figure 6:
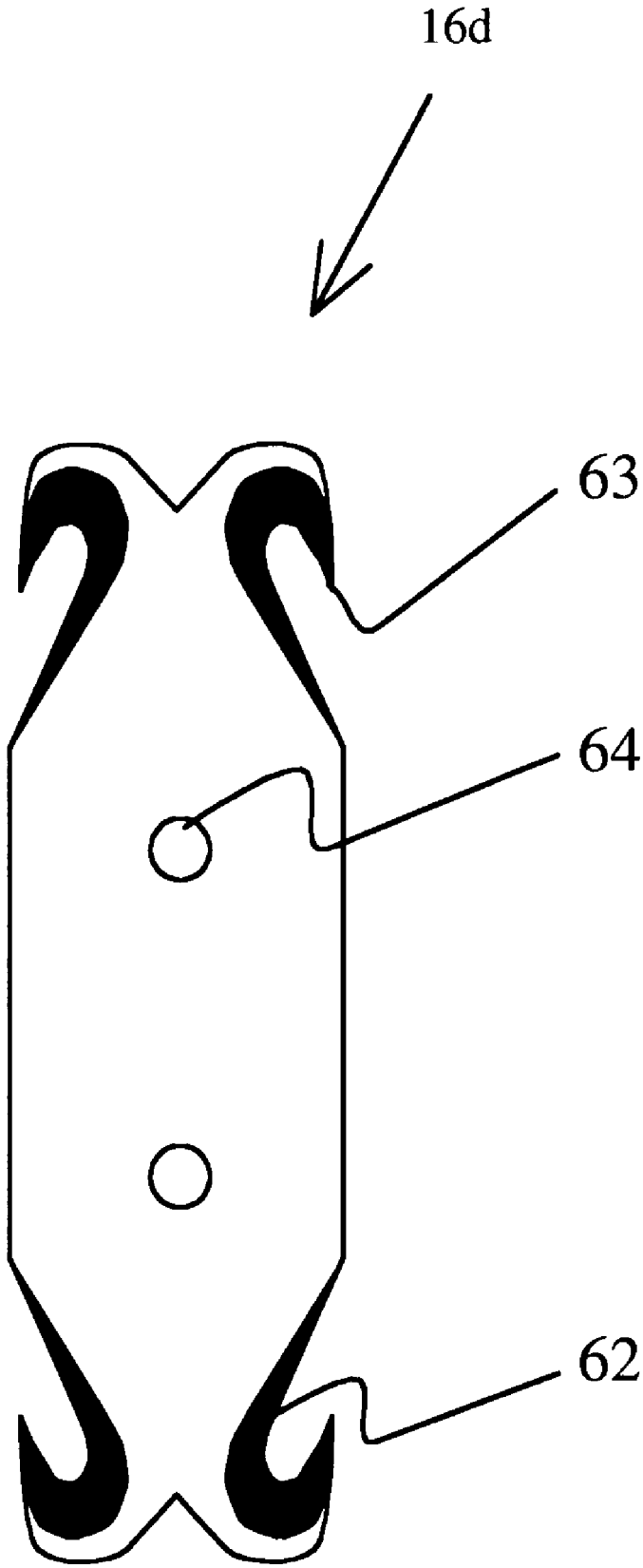
FIG. 6 is a perspective view of the of a corner utility blade knife element 16 for a roofing blade configuration.

Referring to FIG. 6, the detail of the double-edged knife blade element 16 of FIG. 1 configured as a roofing blade is shown at 16*d*. The double-edged roofing blade has sharp hook like corners 63, with sharp cutting edges 62 and two locating holes 64. This double-edged roofing blade may be used in the forward direction only for left-handed or right-handed operation.

Figure 7:
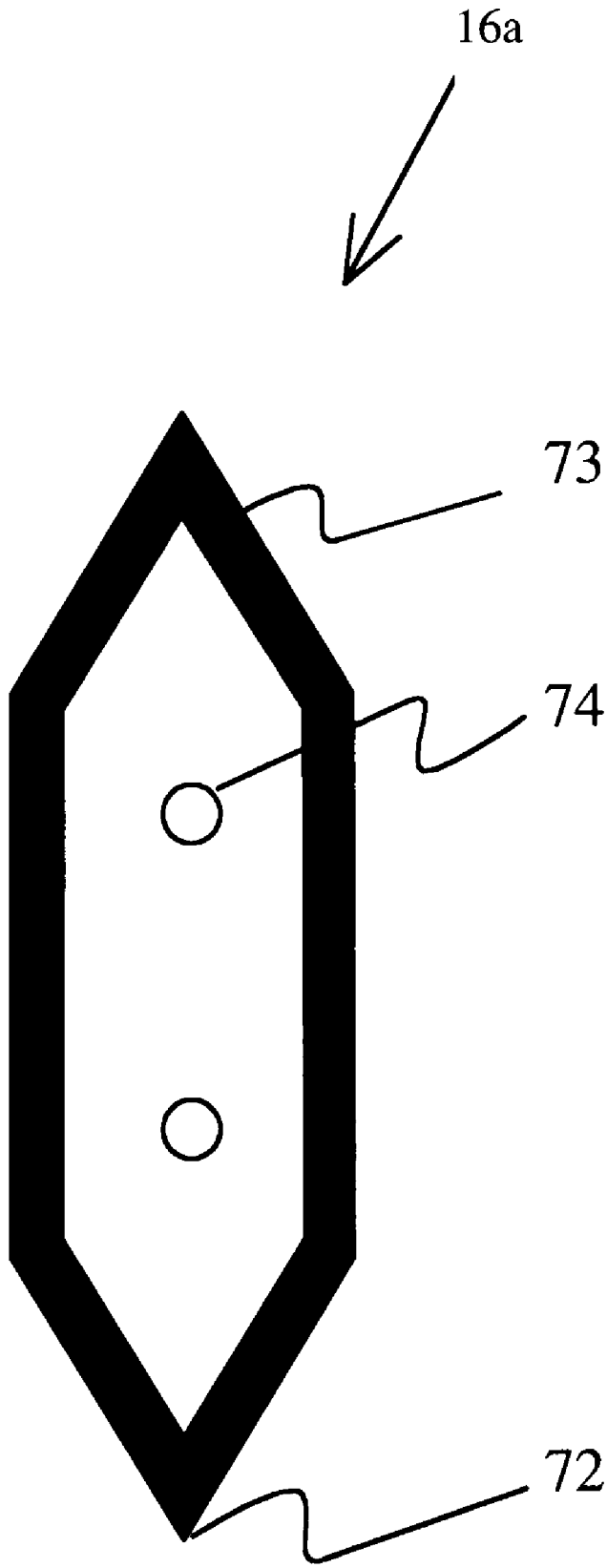
FIG. 7 is a perspective view of the of a corner utility blade knife element 16 for a glazier blade configuration.

Referring to FIG 7, the double-edged knife blade element 16 of FIG. 1 is configured as a glazier blade, shown generally at 16*a*. The double-edged glazier blade 16*a* has a sharp edge 73 and two locating holes 74. The double edge blade has two sharp corners suited for cutting into rubber bead of glass windows at 72. This double-edged glazier blade may be used in the forward direction or reversed direction for left-handed or right-handed operation.

Having thus described the invention in rather full detail, it will be understood that such detail need not be strictly adhered to, but that additional changes and modifications may suggest themselves to one skilled in the art, all falling within the scope of the invention as defined by the subjoined claims. For example different locating member mechanism and blade clamping means may be used to retain the double-edged utility knife blade in the device.

What is claimed is:

1. A utility knife, comprising:

a double-edged knife blade having a flat surface that defines a two-dimensional plane in space; and a substantially V-shaped handle for supporting the blade, said handle comprising a substantially V-shaped first member and a substantially V-shaped second member, wherein said first member is removably attached to said second member in order to create said substantially V-shaped handle and wherein said second member comprises a shoe portion and said first member comprises a tip portion configured to slide into said shoe portion and capture the knife blade, wherein one leg of the V-shape is a gripping portion and the other leg of the V-shape is a blade supporting portion, and said gripping portion is angulated in a fixed manner with respect to said blade such that said gripping portion is angulated away from and out of said two-dimensional plane, and wherein the blade supporting portion comprises a substantially wedge-shaped channel in said second member adjacent said shoe portion, wherein said substantially wedge-shaped channel comprises a planar bottom surface and the knife blade is supported in a lower, off-center position adjacent the planar bottom surface.

2. A utility knife, comprising:

a. a reversible, detachable double-edge blade having a flat surface that defines a two-dimensional plane in space, said blade having a plurality of sharp edges and two anchoring holes;

b. a substantially V-shaped handle for supporting the blade, said handle comprising a substantially V-shaped first member and a substantially V-shaped second member, wherein said first member is removably attached to said second member in order to create said substantially V-shaped handle, wherein one leg of the V-shape is a gripping portion and the other leg of the V-shape is a blade supporting portion, and said gripping portion is angulated in a fixed manner with respect to said blade such that said gripping portion is angulated away from and out of said two-dimensional plane;

c. a substantially wedge-shaped channel means disposed within said blade supporting portion of said second member, wherein said substantially wedge-shaped channel comprises a planar bottom surface and is dimensioned for containing and supporting said double-edged blade;

d. locating means disposed within said substantially wedge-shaped channel means for capturing said double-edged blade;

e. clamping means for clamping said first and second members and supporting said double-edged blade comprising a shoe portion in said second member adjacent an open end of said substantially wedge-shaped channel and a tip portion on said first member, wherein said tip portion is configured to slide into said shoe portion and capture the knife blade in a lower, off-center position adjacent the planar bottom surface; and f. a cavity for holding extra knife blade elements;

whereby a worker may expose a fresh edge of said blade by either replacing said blade with a new blade from said cavity or by rotating said blade by 180 degrees or turning said blade upside down;

and whereby said utility knife can be used for left-handed or right-handed operation.

3. A utility knife as recited in claim 2, wherein said angulation ranges from about 100 degrees to about 170 degrees.

4. A utility knife as recited in claim 2, wherein said angulation ranges from about 135 degrees to about 150 degrees.

5. A utility knife as recited in claim 2, further comprising at least one bolt coupling said first member to said second member.

6. A utility knife as recited in claim 5, wherein said at least one bolt is threaded through said first member.

7. A utility knife as recited in claim 5, wherein said at least one bolt is slidably fitted to said first member.

8. A utility knife as recited in claim 2 wherein said double-edged blade is a wallboard blade with four sharp corners and two sharp cutting edges appointed to cut in a forward or reverse direction during left-handed or right-handed operation.

9. A utility knife, comprising:

a detachable blade having a flat surface that defines a two-dimensional plane in space, the blade having a sharp edge and an anchoring hole; and a substantially V-shaped handle supporting the blade, wherein one leg of the V-shape is a gripping portion and the other leg of the V-shape is a blade supporting portion, and the gripping portion is angulated in a fixed manner with respect to the blade such that the gripping portion is angulated away from and out of the two-dimensional plane, the substantially V-shaped handle comprising:

a substantially V-shaped first member;

a substantially V-shaped second member;

a substantially wedge-shaped channel disposed within the blade supporting portion of the substantially V-shaped second member configured to contain and support the blade, the substantially wedge-shaped channel comprises a planar bottom surface of the blade supporting portion of the substantially V-shaped second member;

a locating pin disposed within the blade supporting portion of the substantially V-shaped handle and configured to engage the anchoring hole in the blade;

a shoe portion configured in the second member adjacent an open end of the substantially wedge-shaped channel; and a tip portion configured on the first member, wherein the tip portion is configured to slide into the shoe portion and capture the blade in a lower, off-center position adjacent the planar bottom surface, thereby removably attaching the first and second members together in order to create said substantially V-shaped handle.

10. The utility knife of claim 9, wherein the angulation ranges from about 100 degrees to about 170 degrees.

11. The utility knife of claim 9, wherein the angulation ranges from about 135 degrees to about 150 degrees.

12. The utility knife of claim 9, further comprising a bolt coupling the first member to the second member.

13. The utility knife of claim 9, wherein the locating pin is coupled to the first member within the substantially wedge-shaped channel.

14. The utility knife of claim 9, wherein the locating pin is in the form of a ball protrusion.

* * * * *